US005797329A

United States Patent [19]

Okada

[11] Patent Number: 5,797,329

[45] Date of Patent: Aug. 25, 1998

[54] HOT MELT INK PRINTER AND METHOD PRINTING

[75] Inventor: Akihiro Okada, Woodland Hills, Calif.

[73] Assignee: Dataproducts Corporation, Woodland Hills, Calif.

[21] Appl. No.: 442,391

[22] Filed: May 16, 1995

[51] Int. Cl.[6] ..... B41L 35/14

[52] U.S. Cl. ..... 101/488; 347/88; 347/102; 347/17; 347/18

[58] Field of Search ..... 101/488; 347/17, 347/18, 8, 26, 29, 60, 102, 108, 223, 88, 21

[56] References Cited

U.S. PATENT DOCUMENTS

| | | | |
|---|---|---|---|
| 2,127,956 | 8/1938 | Helmer | 34/48 |
| 2,261,731 | 11/1941 | Nelson et al. | 91/67.9 |
| 2,268,594 | 1/1942 | Huber | 101/426 |
| 4,073,992 | 2/1978 | Lerman et al. | 428/207 |
| 4,340,893 | 7/1982 | Ort | 346/1.1 |
| 4,664,542 | 5/1987 | Tsugita | 347/18 |
| 4,724,025 | 2/1988 | Nishikawa | 156/230 |
| 4,746,937 | 5/1988 | Rue et al. | 347/17 |
| 4,951,067 | 8/1990 | Spehrley, Jr. | 347/102 |
| 4,970,528 | 11/1990 | Beaufort et al. | 346/25 |
| 4,980,702 | 12/1990 | Kneezel et al. | 347/17 |
| 5,005,025 | 4/1991 | Miyakawa et al. | 346/25 |
| 5,041,846 | 8/1991 | Vincent et al. | 346/25 |
| 5,067,404 | 11/1991 | Frunder et al. | 101/488 |
| 5,182,578 | 1/1993 | Goepel et al. | 347/17 |
| 5,287,123 | 2/1994 | Medin et al. | 347/17 |

FOREIGN PATENT DOCUMENTS

| | | | |
|---|---|---|---|
| 0271090 | 6/1988 | European Pat. Off. | 347/108 |
| 376314 | 7/1990 | European Pat. Off. | 347/17 |
| 356038267A | 4/1981 | Japan | 347/21 |
| 58-142891 | 8/1983 | Japan . | |
| 60-110457 | 6/1985 | Japan . | |
| 63-232105 | 1/1986 | Japan . | |
| 61-47284 | 2/1986 | Japan . | |
| 36-1211045 | 9/1986 | Japan | 347/18 |
| 62-42846 | 2/1987 | Japan . | |
| 2113564 | 5/1987 | Japan | 347/17 |
| 62-111749 | 5/1987 | Japan | 347/102 |
| 62-135370 | 6/1987 | Japan . | |
| 62-149452 | 7/1987 | Japan . | |
| 3109083 | 5/1988 | Japan | 347/102 |
| 1011841 | 1/1989 | Japan | 347/102 |
| 401064859A | 3/1989 | Japan | 347/21 |
| 40-2165960 | 6/1990 | Japan | 347/17 |
| 402192952A | 7/1990 | Japan | 347/21 |
| 40-2258346 | 10/1990 | Japan | 347/17 |
| 2305646 | 12/1990 | Japan | 347/88 |
| 328650 | 12/1991 | Japan | 347/18 |
| 404329142A | 11/1992 | Japan | 347/88 |
| 4353462 | 12/1992 | Japan | 347/18 |
| 405004337A | 1/1993 | Japan | 347/88 |
| 5147204 | 6/1993 | Japan | 347/102 |
| 40-5338176 | 12/1993 | Japan | 347/17 |
| 6182986 | 7/1994 | Japan | 347/17 |
| 6255208 | 9/1994 | Japan | 347/18 |
| 94-019197 | 9/1994 | WIPO | 347/18 |

OTHER PUBLICATIONS

Search Report for PCT/US96/06939 International Filing Date 15 May 1996.

*Primary Examiner*—Eugene H. Eickholt
*Attorney, Agent, or Firm*—Pillsbury Madison & Sutro LLP

[57] ABSTRACT

A printer and a method for printing hot melt ink in which an ink jet is surrounded by an enclosure and including a heater for heating the air within the enclosure. The enclosure has an opening so that the heated air can be directed towards a medium for heating the medium prior to ejecting droplets of hot melt ink onto the medium. The ink droplets cool and solidify into a shape having a low contact angle.

14 Claims, 3 Drawing Sheets

HOT MELT INK PRINTER AND METHOD PRINTING

BACKGROUND OF THE INVENTION

1. Field of the Invention

This invention relates to the control of the solidification of ink droplets made of hot melt material used as ink in printing on various media. Particular embodiments of the invention relate to a printer device and method for printing involving heating the front surface of a print medium in the region where ink droplets are applied to the medium.

2. The Related Art

Printing mechanisms have applied heat to a recording medium, in order to speed up the fixing or drying process of aqueous or solvent based inks, in order to control the amount of moisture on the paper. Hot melt inks, also called phase change inks, behave differently from aqueous inks. Hot melt inks become fixed on the medium by freezing, not by evaporative drying.

When printing on a recording medium using hot melt ink, it is crucial to control the rate of solidification of ink droplets as they strike the medium. The high surface tension and high viscosity of hot melt ink (compared with water-based inks) of the ink makes it very difficult to get each droplet to form a uniformly shaped dot on the medium, especially if the diameter of the dot must be controlled within a tight tolerance range.

Controlling the solidification of ink droplets on the surface of a medium is particularly important when printing on transparencies. Various prior hot melt ink jet printers do not achieve good print quality when printing on transparencies for a variety of reasons. At least in part due to the transparency medium's inability to absorb the ink, ink droplets tend to dry and adhere in the form of tiny lenses on the transparency surface. These lenses disperse light and the resultant image is less than satisfactory when projected onto a screen.

Some prior art printing systems have used various approaches to controlling the solidification of ink droplets, including the heated platen and the post processor methods. In many cases, these approaches have not proven satisfactory when used in conjunction with a hot melt ink.

With the heated platen approach, the medium is conveyed over a heated platen which heats the medium from the rear. There are several problems that can arise when using a heated platen or other form of rear heating. First, it is difficult to control the temperature of the medium at the location and surface where the ink is being applied. The temperature of the front printing surface (the surface on which ink is applied) will vary depending on the thickness, weight and material of the medium. The platen temperature must be fully adjustable in order to compensate for different media and keep the printing even and the medium at a uniform temperature to maintain adequate print quality.

In addition, it is difficult to control the temperature of the medium over a wide area because the heating is confined to a section where the medium is in close contact with the platen. This causes the medium to expand and wrinkle. Wrinkling can cause hot spots and smeared images. This is particularly a problem with heat sensitive materials like some mediums used for transparencies. In addition, if the temperature is not uniform over a sufficient area, the droplets will not form symmetrical dots. Rear heating (such as a heated platen) also increases the tendency of the ink to bleed through the paper towards the heat source.

Problems can also occur due to thermal expansion characteristics of the components for guiding the paper into position for printing. For example, the paper guide components in contact or close to the platen will become heated due to their proximity to the heated platen. Other portions of the paper guide will not be heated to the same extent, and this uneven temperature distribution will cause distortion in the components. Under such circumstances the medium will not be held in uniform position by the guide and may move away from the platen, thereby causing uneven printing on the medium and uneven drying, and wrinkling.

Under the post-processor approach, either a heater is used to remelt the ink or a pressure roller is used to spread the ink after the ink has been initially applied (e.g. by an ink jet head) to the medium. The post processing approach can be unsatisfactory for several reasons. First, post-processing is an extra step which increases the time complexity and cost of printing. Second, post-processing may not be appropriate for printing on transparencies because the acuity of the image tends to decrease. Third, remelting can degrade the print quality and increase ink bleed-through on some media.

U.S. Pat. No. 5,005,025 to Miyakawa et al., describes several printers designed to improve the fixation of ink on a recording sheet, by the ink penetrating into the sheet or by vaporizing the solvent in the ink to fix the ink pigment on the sheet. One embodiment uses a heated platen which overcomes the temperature distribution problem by designing the paper guide to minimize uneven temperature distributions in the guide mechanism where it contacts the medium.

The '025 patent also describes several other approaches to fixing the ink to the medium, including an approach similar to the heated platen method in which a heating component is located adjacent to the platen along the medium path which heats the medium from the back side to fix the ink to the medium. Another method includes a heater located along the paper guide path after the printing zone. These methods all relate to fixing the ink by evaporating the solvent in the ink. One other embodiment described in the '025 patent includes the application of a suction force to the back of the medium to help fix the ink to the medium.

U.S. Pat. No. 4,970,528 to Beaufort et al. describes a method for drying ink on paper where the paper travels in a 180 degree transport path after printing and is heated by an infrared bulb located along the path.

U.S. Pat. No. 5,041,846 to Vincent et al. describes a printer for printing highly aqueous inks containing heaters adjacent to the ink jet designed to heat each line of print both before and after ink is applied to the sheet. The preheating is carried out to remove moisture from the surface of the sheet, and the post heating is carried out to remove moisture from the ink ejected onto the sheet. The '846 patent also describes the use of a heated roller, located along the paper path after the printing is complete. While the heaters adjacent to the ink jet can be operated to dry the ink to avoid smearing, the '846 patent notes that further heating of the sheet is often needed to remove residual ink moisture and to remove cockles (wrinkles) which form due to the residual moisture.

U.S. Pat. No. 4,340,893 to Ort describes a printer having a dryer with ports located adjacent to the ink jet nozzles. The ports are sized and aimed to impinge on the recording surface along each line of printing in order to effect drying of the ink. Neither Vincent nor Ort describes printing using a hot melt ink, and neither teaches the use of heat to control the droplet morphology in order to form uniform, flattened droplets using a minimum of ink.

Japanese patent publication 62-135370 discloses a printer for printing a hot melt ink on paper. The '370 reference teaches heating the medium with a fixed heater located along the path of the medium before the printhead. As shown in FIGS. 4 and 5 of the '370 reference, the heater is located adjacent to the platen and the medium is heated prior to approaching the printhead.

Because the medium is heated prior to entering the printing zone adjacent the printhead, the medium will tend to cool prior to printing. As a result, the medium must be heated to a relatively high temperature using the method of the '370 reference.

In addition, the '370 reference describes an open print zone which tends to result in a relatively non-gradual and non-uniform temperature gradient around the ink droplet location. According to the '370 reference, the area of the medium below the point where the ink is applied will be hotter than the area above the point where the ink is applied. Furthermore, the ink jet is not located within the heat stream and must be specially heated, using more energy. Also, the '370 reference employs only a heating mechanism and can adjust the medium temperature only by heating the medium.

Accordingly, there is a need in the industry for a printing apparatus and process which addresses the above-discussed problems associated with rear heating and pre- or post-heating.

SUMMARY OF THE DISCLOSURE

It is the object of embodiments of the present invention to control the diameter of the dots formed on the surface of a medium within a tight tolerance range, while obtaining a uniform print quality regardless of the thickness of the medium. It is a further object to produce a uniform gradual temperature gradient over the printing surface and thereby decrease the tendency of wrinkling, to decrease the occurrence of ink bleeding through the medium, and to improve the control over the fuzziness and color banding of the ink. Another object is to form droplets have a flat droplet morphology, using a minimum amount of ink. In addition, it is yet a further object of embodiments of the present invention to achieve a constant ink solidification rate regardless of the printing speed.

In accordance with these and other objects of the present invention, one embodiment of the present invention provides for a printer for printing hot melt ink including a platen designed to support a medium on which is printed hot melt ink. The printer contains a printhead containing an ink jet for ejecting hot melt ink onto the medium. The printer also contains an enclosure surrounding the printhead and defining an open region in the area around the ink jet and adjacent to the platen. A heater is also mounted in the printer to provide hot air to heat the medium.

Other embodiments include a printer having an ink jet for applying droplets of hot melt ink onto the front surface of a medium. The ink jet is surrounded in part by an enclosure, with the enclosure having an open region in front of the ink jet where the ink is ejected. The printer also includes a heater which heats the air, and the heated air contacts the front surface of the medium through the open region in the enclosure.

Other embodiments include a method for printing utilizing an ink jet, a hot melt ink, and a medium for receiving the ink. Hot air is applied to a printing zone on the front surface of the medium and then the ink is ejected onto the heated medium, where it forms low contact angle droplets as it is cooled.

BRIEF DESCRIPTION OF THE DRAWINGS

Further objects, advantages and features of embodiments of the present invention will become apparent from the description below, when read in conjunction with the accompanying drawings (which, for illustrative purposes, are not drawn to scale), where.

DETAILED DESCRIPTION OF PREFERRED EMBODIMENTS

This description contains the best mode for carrying out the present invention and is made for the purpose of illustrating the principles of preferred embodiments of the invention, and is not to be taken in a limiting sense. The scope of the invention is best determined by reference to the appended claims.

Figure 1:
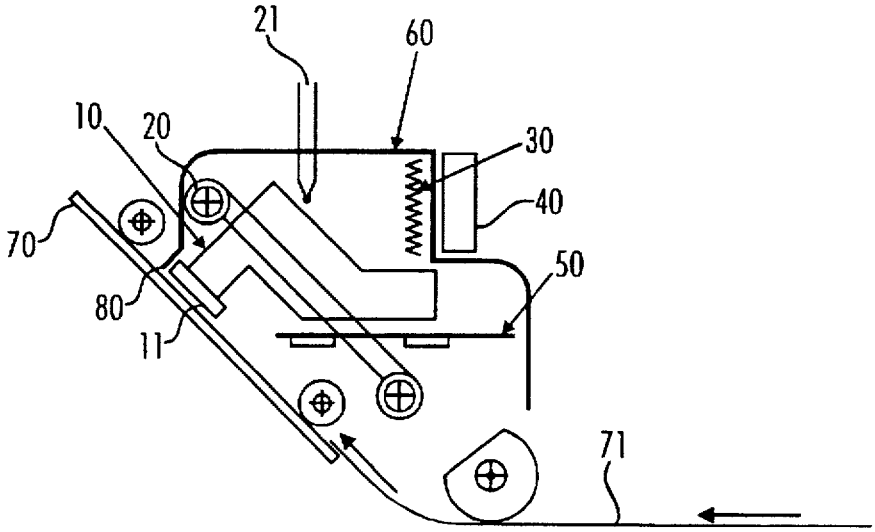
FIG. 1 is a schematic side view of a printer according to one embodiment of the present invention.

Embodiments of the present invention relate to a printer device and a method for controlling the rate of solidification of ink droplets onto a medium. FIG. 1 shows one embodiment of the present invention which includes an ink jet carriage, sometimes referred to as a printhead 10, which houses the ink jet mechanism. The printhead 10 is slidably mounted on guide shafts 20. Behind the printhead is a heater 30, and a fan or blower 40. Also present is a printhead driver board 50. The printhead 10, the heater 30, and the printhead driver board 50 may be contained in an enclosure 60. The fan or blower 40 is capable of blowing air across a heating element towards the platen 70. In certain embodiments the blower 40 is capable of either blowing air towards to platen 70 or pulling air away from the platen 70.

The printhead 10 is mounted on the carriage 20, which can be moved from side to side within the enclosure 60. The enclosure 60 may be structured to be the same width as the printing area on the medium on the platen 70. The enclosure 60 as shown in FIG. 1 defines an open region which generally faces towards the platen 70, and one edge 80 of the enclosure 60 is located close to the printhead 10. The open region of the enclosure 60 helps to define a printing zone which surrounds the printhead 10 on the surface of a medium located on the platen 70. Use of a heater 30 and blower 40 is not the only possible method of heating the printing zone, but it is a preferred method of doing so because the combination of blower 40 and heater 30 can also be used to both heat and cool the printing zone and thus it is possible to maintain fairly precise control of the temperature on the surface of a medium located on the platen 70 when the medium is located within the print zone. A variety of temperature sensors, such as a thermistor or thermocouple 21 may also be present and may be located near the heater 30 or elsewhere within the heated area.

Embodiments such as that shown in FIG. 1 may be used for printing onto a medium located on the platen 70, such as a sheet of paper or a transparency suitable for use with an overhead projector. The medium is conveyed to the platen to be positioned adjacent to the opening of the heated enclosure 60. A zone on the medium, at least partially defined by the shape of the opening to the heated enclosure 60, is heated by exposure to the hot air blown through the enclosure 60. The printhead 10, which is contained within the heated enclosure 60, passes back and forth over the heated surface of the medium, and deposits droplets of melted ink onto the heated surface of the medium. Because a wide area of the medium on the platen 70 around the printhead 10 has been heated to a uniform temperature, the ink droplet will spread relatively evenly in all directions, and thus a droplet with a substantially uniform diameter will be formed on the medium.

Figure 2:
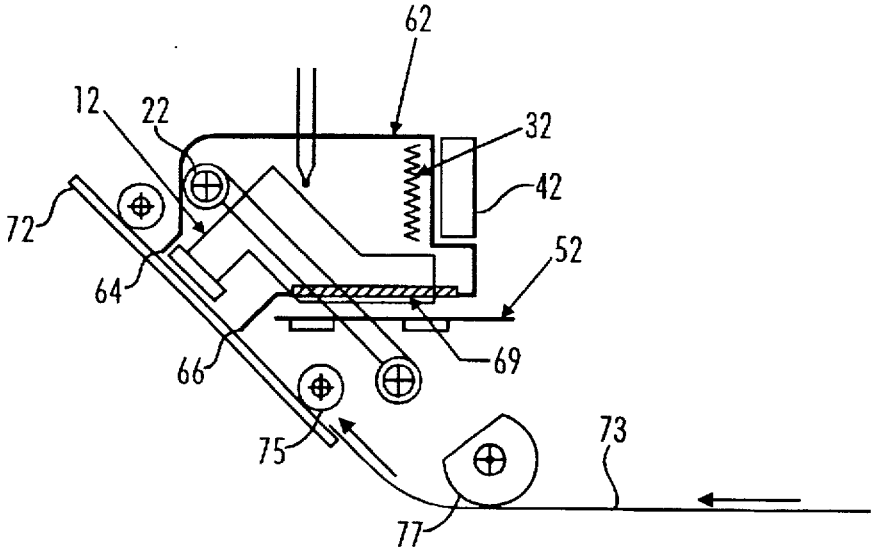
FIG. 2 is a schematic side view of a printer according to a second embodiment of the present invention.

A further embodiment is shown in FIG. 2. The printing device includes an ink jet carriage or printhead 12, mounted on guide shafts 22, as well as a heater 32, a fan or blower 42, and a printhead driver board 52. The printhead 12 and the heater 32 are contained in an enclosure 62. The printhead driver board 52 and certain associated electrical cables (not shown) connected to the printhead driver board 52 are located outside of the enclosure 62. The enclosure 62 defines an open region bounded by enclosure edges 64 and 66. The enclosure may also contain a flexible wall 69, which enables the printhead 12 to move within the heated region and at the same time keeps the heat loss to a minimum. The flexible wall 69 may have an accordion-type structure so that it can flexibly move as the printhead 12 moves. The open region in turn defines the printing zone on a medium on platen 72. The medium 73 may be drawn into position on the platen 72 for printing through the use of rollers 75, 77 such as those shown in FIG. 2.

The structure as shown in FIG. 2 may contain less volume and mass within the enclosure 62 and may define a smaller open heated region than that shown in FIG. 1. Therefore, embodiments such as that shown in FIG. 2 may require less energy to heat the printing surface than embodiments as shown in FIG. 1. In addition, by keeping the printer driver board 52 outside of the enclosure 62, any possible problems due to heating of the components on the board 52 will be minimized.

Figure 3:
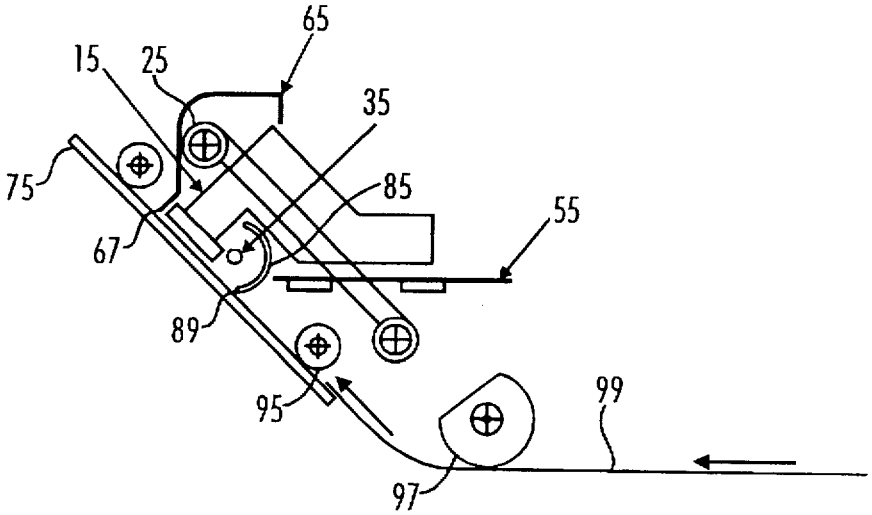
FIG. 3 is a schematic side view of a printer according to a third embodiment of the present invention.

Other embodiments of the present invention may have a structure such as that shown in FIG. 3, which includes an ink jet carriage or printhead 15, mounted on guide shafts 25, as well as a heater 35, and a printhead driver board 55. A cover 65 may surround the upper portion of the printhead 15 as shown in FIG. 3. The printhead driver board 55 is located underneath of both the printhead 15 and the cover 65. A heater 35 is also located beneath the printhead 15 and the cover 65, and a shield 85 partially surrounds the heater 35. The heater 35 may of the linear type, and the use of a blower is not necessary.

An open area is defined by one edge 67 of the cover 65 and the lower edge 89 of the shield 85. The open region in turn defines the heating zone on a medium on platen 72. The medium may be drawn along platen 75 into position for printing through the use of rollers such as those shown in FIG. 3 as 95 & 97. The medium 99 is conveyed along the platen 75 and past the heater 35 and the printhead 15, where ink is applied to the heated front surface of the medium. The heater 35 and the printhead 15 are positioned close together and the layout is such that a heated area is maintained within the region bounded by the cover 65, the printhead 15 and the shield 85, and as a result the heated medium surface does not significantly cool between the time of initial heating and printing.

A configuration such as that shown in FIG. 3 may require less energy to heat the printing surface than embodiments as shown in FIG. 1, because there is less mass within the enclosed area. The printer driver board 55 is separated from the heat element 35, and only part of the printhead assembly is located within the heated region.

Further embodiments of the present invention relate to methods of printing ink onto a medium. In certain embodiments a medium is provided having a front side adapted for receiving a hot melt ink and a back side which is in contact with a platen for supporting the medium. Heat is applied to a printing zone on the front side of the medium, and then hot melt ink is then applied to the printing zone.

The printing zone may be preferably heated through the use of heated air directed towards the medium on the platen. Other gases than air could also be used for heating the printing zone. The printing zone gas contacts the printing zone on the front side of the medium. A front heating method (i.e. the heat is directed towards and initially contacts the front of the medium) has advantages over a heated platen approach. In the heated platen approach there is a greater tendency for the ink to bleed through the medium, because the ink tends to run towards the area with the most heat. Furthermore, the front heating method does not require the heating of a mass of material such as a platen.

In other embodiments, the heated gas may also be used to heat the hot melt material prior to its ejection through the ink jet. Thus, having the heat transmitted on both the printhead and the medium may serve dual purposes in that the heat prepares the medium so that low contact angle or flattened droplets are formed as well as the heat helping to prepare the hot melt material for printing.

Figure 4:
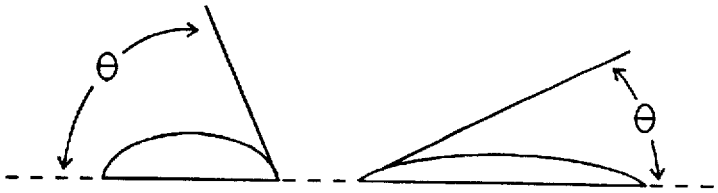
FIG. 4 is a schematic representation of the contact angle of a droplet of hot melt ink ejected onto (a) an unheated medium; and (b) a heated medium.

In another aspect of embodiments of the present invention, the printing zone is heated to a temperature below the liquidous temperature of the ink, in order to obtain the optimal amount of spreading and flattening of the ink droplet. The ink solidification is controlled by the temperature and the duration of the media within the heated zone. FIG. 4 shows a comparison of droplet formation according to embodiments of the present invention versus droplet formation using other methods or devices. The droplets that form on the heated surface have a low contact angle θ, as seen in FIG. 4*a*. Such droplets are wider and thinner than the droplets that would be formed on an unheated surface, as seen in FIG. 4*b*, where the droplet has a larger contact angle θ.

Figure 5:
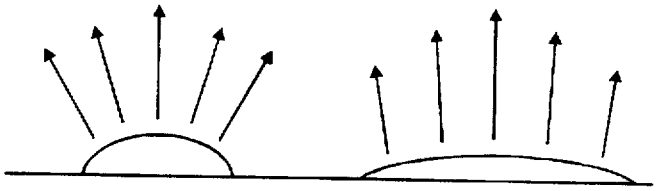
FIG. 5 is a schematic representation of the direction of light transmission through a droplet of hot melt ink having (a) a larger contact angle; and (b) a smaller contact angle.

If the droplet has a large contact angle, it will tend to act like a lens. The light passing through the drop will be refracted, and leave the drop along a direction different than that entered the drop, as shown in FIG. 5*a*. Thus high contact angle drops tend to cause significant scattering of light passing through the drop. Droplets made in accordance with preferred embodiments of the present invention have a low contact angle, and as shown in FIG. 5*b*, cause significantly less scattering of light passing through them.

Furthermore, high contact angle droplets will reflect light in a more scattered manner than low contact angle droplets. Low contact angle droplets, having a more flattened surface, will tend to reflect light back in the direction it came in, thus creating an enhanced image.

Figure 6:
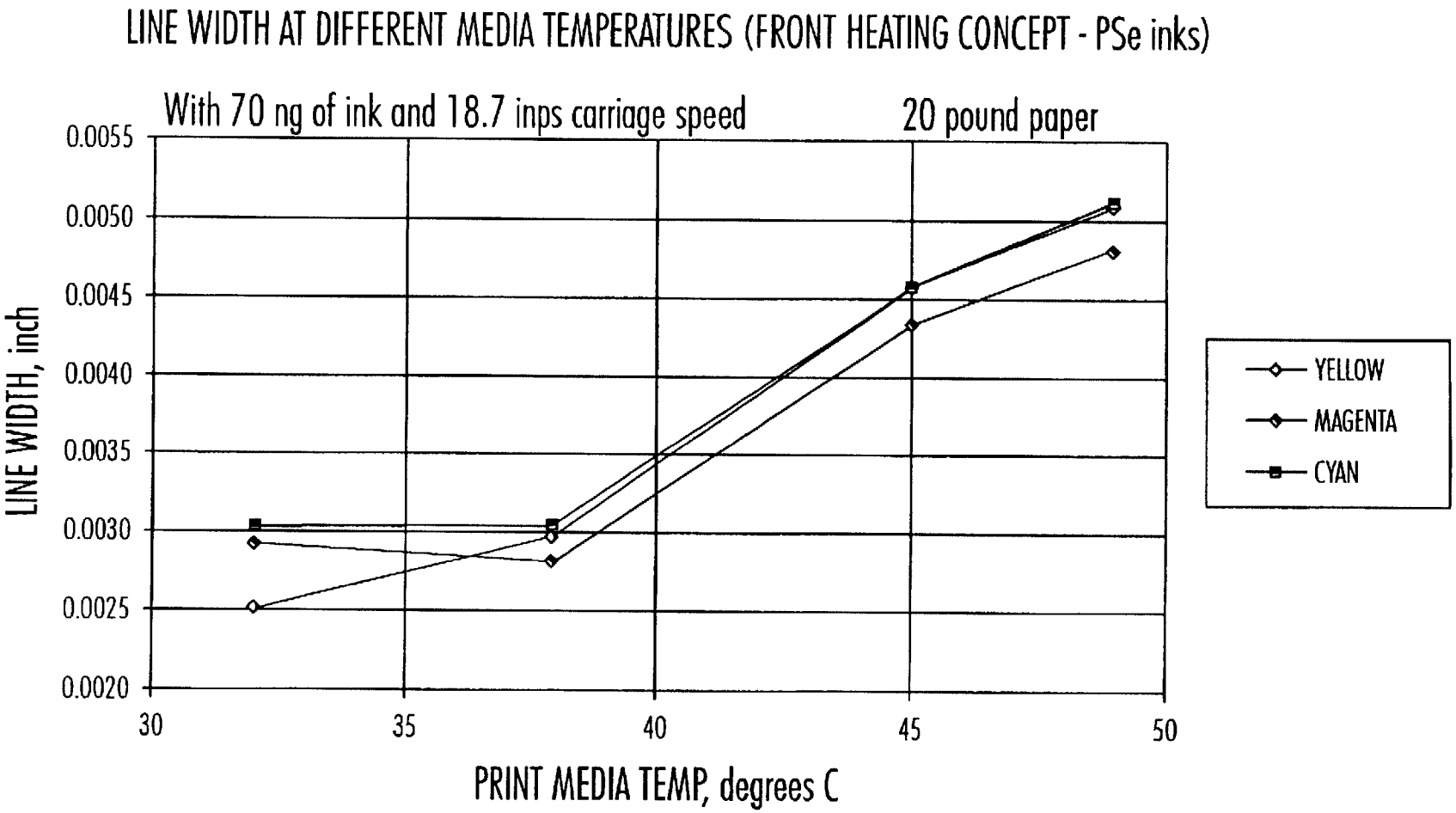
FIG. 6 is a graph of printed line width versus temperature of the medium.

FIG. 6 shows a typical graph of line width at different media temperatures using a hot melt ink in accordance with embodiments of the present invention. The graph shows that on 20 pound bond paper, with 70 ng (nanograms) of ink and an 18.7 ips (inches per second) carriage speed, the line width changes with media temperature. For the particular formulations of yellow, magenta, and cyan inks, the front heating of the media had an effect on the dot size at around 38° C., where for each of the three ink formulations the line width increased as the media temperature increased. For these particular ink formulations, the ideal temperature for optimal ink spread and bleed through properties was found to be around 45–48° C.

Finally, numerous variations of the described device and procedures may readily occur to those skilled in the art once they have been made familiar with the disclosure of the present invention.

I claim:

1. A printer for applying a hot melt material onto a front surface of a medium, the print comprising:

an ink jet printhead for ejecting droplets of hot melt material in an ink droplet flow path toward and onto the front surface of the medium;

an enclosure surrounding said ink jet printhead, the enclosure defining an opening adjacent to the front surface of the medium;

a heater mounted in a location separate from the ink jet printhead within the enclosure for heating air within the enclosure; and a fan mounted in a location separate from the ink jet printhead for directing the heated air towards the front surface of the medium, wherein said fan is located external to the ink droplet flow path and is oriented to direct the heated air within the enclosure and along an air flow path external to the printhead and at least partially external to the ink droplet flow path.

2. A printer as in claim 1, wherein the enclosure comprises a tunnel and the heater is located near a first end of the tunnel, and the platen is located near a second, opposing end of the tunnel.

3. A printer for applying a hot melt material onto a front surface of a medium, the print comprising:

an ink jet printhead for ejecting droplets of hot melt material in an ink droplet flow path toward and onto the front surface of the medium;

an enclosure surrounding said ink jet printhead, the enclosure defining an opening adjacent to the front surface of the medium;

a heater for heating air within the enclosure; and a fan for directing the heated air towards the front surface of the medium, wherein said fan is located external to the ink droplet flow path and is oriented to direct the heated air within the enclosure and along an air flow path external to the printhead and at least partially external to the ink droplet flow path;

the enclosure comprising a body having at least one wall portion which is oriented substantially perpendicular to the platen for directing heated air towards a medium disposed on the platen.

4. A printer for applying a hot melt material onto a front surface of a medium, the print comprising:

an ink jet printhead for ejecting droplets of hot melt material in an ink droplet flow path toward and onto the front surface of the medium;

an enclosure surrounding said ink jet printhead, the enclosure defining an opening adjacent to the front surface of the medium;

a heater for heating air within the enclosure; and a fan for directing the heated air towards the front surface of the medium, wherein said fan is located external to the ink droplet flow path and is oriented to direct the heated air within the enclosure and along an air flow path external to the printhead and at least partially external to the ink droplet flow path;

the heater being mounted behind the ink jet of the printhead and within the enclosure, and a fan being disposed outside of the enclosure in a position adjacent to the heater so that the fan can direct air or some other gas across the heater and through the enclosure towards the platen.

5. A printer for applying a hot melt material onto a front surface of a medium, the print comprising:

an ink jet printhead for ejecting droplets of hot melt material in an ink droplet flow path toward and onto the front surface of the medium;

an enclosure surrounding said ink jet printhead, the enclosure defining an opening adjacent to the front surface of the medium;

a heater for heating air within the enclosure; and a fan for directing the heated air towards the front surface of the medium, wherein said fan is located external to the ink droplet flow path and is oriented to direct the heated air within the enclosure and along an air flow path external to the printhead and at least partially external to the ink droplet flow path;

the enclosure comprising a body having two walls defining a ledge for supporting the fan.

6. A printer for applying a hot melt material onto a front surface of a medium, the print comprising:

an ink jet printhead for ejecting droplets of hot melt material in an ink droplet flow path toward and onto the front surface of the medium;

an enclosure surrounding said ink jet printhead, the enclosure defining an opening adjacent to the front surface of the medium;

a heater for heating air within the enclosure;

a fan for directing the heated air towards the front surface of the medium, wherein said fan is located external to the ink droplet flow path and is oriented to direct the heated air within the enclosure and along an air flow path external to the printhead and at least partially external to the ink droplet flow path; and a printhead driver board for controlling the printhead, the printhead driver board being mounted below the heater and below the ink jet of the print head.

7. A printer as in claim 6, wherein the enclosure covers the printhead driver board.

8. A method of printing hot melt material using an ink jet head, heated gas and a medium, the medium having a front surface adapted for receiving the hot melt ink, the method comprising the steps of:

defining a printing zone on the front surface of the medium;

providing the heated gas external to and separate from the ink jet head;

directing the heated gas external to and separate from the ink jet head and toward the printing zone;

heating the hot melt ink to be ejected through the ink jet head;

heating the printing zone on the front surface of the medium with the heated gas directed external to and separate from the ink jet head; and ejecting a hot melt material from the ink jet head, along a flow path toward and onto the heated printing zone;

wherein said step of directing the heated gas, comprises the step of directing heated gas in a gas flow path at least partially external to and independent of the flow path of the hot melt material.

9. A method of printing low contact angle droplets using a hot melt ink, an ink jet, heated air and a medium, the medium having a front surface adapted for receiving the hot melt ink, the method comprising the steps of:

defining a printing zone on the front surface of the medium adjacent to the ink jet;

heating the printing zone by providing heated air external to and separate from and not within the ink jet and directing the heated air towards the printing zone; and ejecting a hot melt ink from the ink jet in an ink flow path toward and onto the heated printing zone to form a droplet having a lower contact angle than if the printing zone were not heated;

wherein the step of heating the printing zone comprises the step of directing heated air in an air flow at least partially external and independent of the ink flow path.

10. A method as in claim 9, wherein at least part of the printing zone is heated to a temperature below the liquidous temperature of the hot melt ink.

11. A method of as in claim 9, wherein each droplet is cooled in a manner which yields a droplet having a substantially flattened region on its surface.

12. The method of claim 9, wherein said step of heating the printing zone comprises the steps of:

operating a fan external to and separate from the ink jet to provide an air flow external to the ink jet and directed toward the printing zone;

heating the air flow with a heater external to and separate from the ink jet to control the temperature of the printing zone.

13. A method of printing hot melt material onto a medium having opposing front and back surfaces, with the back surface in contact with a platen and the front surface adapted for receiving the hot melt material from a printhead, the method comprising the steps of:

defining a printing zone on the front surface of the medium;

applying the hot melt material from the printhead to the printing zone, wherein the hot melt material applied to the printing zone defines an ink surface extended outward from the front surface of the medium;

generating heat external to and separate from the printhead;

flattening at least a portion of the ink surface extended outward from the medium by applying the heat generated external of the printhead to the printing zone such that the heat is applied to the front surface of the medium before being conveyed through the medium to the back surface of the medium; and cooling the hot melt material in a controlled manner on the medium.

14. The method of claim 13 wherein the printing zone is heated to a temperature below the liquidous temperature of the hot melt material.

* * * * *